United States Patent [19]

Panicker et al.

[11] Patent Number: 4,613,793

[45] Date of Patent: Sep. 23, 1986

[54] LIGHT EMISSION ENHANCING DIELECTRIC LAYER FOR EL PANEL

[75] Inventors: Ramachandra M. P. Panicker, Camarillo; Walter F. Essinger, Thousand Oaks, both of Calif.

[73] Assignee: Sigmatron Nova, Inc., Thousand Oaks, Calif.

[21] Appl. No.: 638,297

[22] Filed: Aug. 6, 1984

[51] Int. Cl.[4] ..... G09G 3/10

[52] U.S. Cl. ..... 315/169.3; 313/506; 313/507; 340/781

[58] Field of Search ..... 313/506, 507, 508, 509, 313/483, 494; 315/169.3; 340/781

[56] References Cited

U.S. PATENT DOCUMENTS

| | | | |
|---|---|---|---|
| 3,274,024 | 9/1966 | Hill et al. | 313/509 |
| 3,560,784 | 2/1971 | Steele et al. | 313/509 |
| 4,369,393 | 1/1983 | Frame | 313/506 |
| 4,455,506 | 6/1984 | Ayyagari et al. | 313/506 |

*Primary Examiner*—Saxfield Chatmon
*Attorney, Agent, or Firm*—John T. Matlago

[57] ABSTRACT

A thin-film electroluminescent panel which has a light sink layer deposited immediately behind the phosphor layer thereof is modified to have a light emission enhancing dielectric layer deposited between the phosphor layer and the light sink layer. The light emission enhancing dielectricphosphor interface provides for injecting hot electrons for impact-exciting the luminescent centers in the phosphor to enable the panel to generate light when the front electrode of the panel is positive in potential. Moreover, the light emission enhancing dielectric layer is formed of a material having the same index of refraction as the phosphor layer so that it will pass the incident ambient light and the rearwardly directed light generated in the phosphor layer without reflection into the light sink layer wherein it is trapped by internal reflection and absorbed.

8 Claims, 10 Drawing Figures

(a)
VOLTAGE
40
E
W
GROUND
E
41
(b)
LUMINANCE
42
43
TIME (a)
VOLTAGE
40
E
W
E
41
(b)
LUMINANCE
46
43
TIME

ITO
+
44
Al
−
18
20
22
16

ITO
+
48
Al
−
18
20
19
22
16

ITO
−
45
Al
+
16
18
20
22

ITO
−
45
Al
+
16
18
19
20
22

LUMINANCE (FOOT LAMBERTS)
$10^3$
$10^2$
$10^1$
1
51
50
52
~5-10 VOLTS
100
150
200
VOLTAGE

LIGHT EMISSION ENHANCING DIELECTRIC LAYER FOR EL PANEL

This invention relates to electroluminescent (EL) panels and, more particularly, to a novel construction which provides for enhancing the luminescence thereof.

BACKGROUND OF THE INVENTION

High ambient illumination imposes severe problems on an EL display panel inasmuch as legibility of the information being displayed is reduced under such conditions. The cause of this poor legibility is the reflected ambient light from the back metal electrodes and other interfaces in the display panel which reduces the contrast ratio of the lit to the unlit pixels on the panel, i.e., the ratio of the brightness of the displayed image to the brightness of the background of the panel.

Of the several solutions that have been proposed to solve this problem, the one that provides for negligible internal reflection and diffusion of the ambient light is the placement of a light sink layer immediately behind the phosphor layer. A material which is admirably suited for such a light sink layer is disclosed in a copending U.S. patent application, Ser. No. 541,702, filed Oct. 13, 1983, by Ramachandra M. P. Panicker, and assigned to the same assignee as the present invention. This material is a light absorbing semiconductor compound which is especially adapted to have a high specific resistivity.

In particular, this light sink layer material is characterized as having a high light absorption coefficient and an index of refraction which is much higher than the two adjoining layers, namely, the phosphor layer on the front thereof and the dielectric layer on the rear thereof. Such a light sink layer results in the ambient light incident thereon not being reflected but, rather, trapped by total internal reflection and absorbed within the layer. Moreover, the performance of a matrix-addressed EL panel is greatly improved by the use of such a high resistivity light sink layer material in that the voltage drop thereacross is reduced and the steepness of the luminance vs. voltage characteristic curve is increased as desired for multiplexing operation of such an EL panel.

As pointed out in the above referred to patent application, although the light sink layer made of a semiconductor material having a high specific resistivity, on the order of $10^8$ to $10^{12}$ ohm-centimeter, was closer to being a dielectric, nevertheless, during the refreshing of a pixel on the panel by the use of an alternating drive voltage, it was only during the half cycle that the back electrode was positive in potential that light was generated in the panel. A negligible amount or no light was generated during the half cycle that the front electrode was positive in potential.

However, in spite of the fact that the EL panel only generated light in the phosphor layer during the half cycle that the back electrode was positive in potential, nevertheless, the fact that incident ambient light impinging on the light sink layer was not reflected but totally absorbed therein not only caused the background of the panel to be black but so greatly increased the contrast ratio of the panel that it was readable under sunlight conditions, for example. It should be appreciated, however, that in view of the need to be able to read panels under all kinds of severe ambient lighting conditions and the continued effort to improve the efficiency of the panel, it is highly desirable to still further increase the light output and, therefore, the contrast ratio of the EL panel.

SUMMARY OF THE INVENTION

In accordance with the present invention, in order to enable the portion of the phosphor layer forming a pixel on an EL panel, provided with a light sink layer, to emit light during the half cycle of a refresh operation that the front ITO (Indium Tin Oxide) electrode of a pixel is positive in potential with respect to the back Al (aluminum) electrode, a thin light emission enhancing dielectric layer having substantially the same refractive index as the phosphor layer is deposited on the back of the phosphor layer followed by the depositing of the semiconductor light sink layer.

It should be particularly noted that by forming the light emission enhancing layer with a dielectric material having substantially the same refractive index as the phosphor layer, there is no reflection of ambient light or rearwardly directed internally generated light at the interface of these layers which would decrease the contrast ratio of the panel. Moreover, the presence of the light emission enhancing dielectric layer between the phosphor layer and the light sink layer enables this dielectric layer to be able to supply high energy electrons to impact-excite the luminescent centers provided in the phosphor layer to thereby generate light during the refreshing half cycle that the front ITO electrode is positive in potential. Thus, the EL panel is now able to generate light when the ITO is positive in potential to the same degree as when the Al electrode is positive in potential.

Accordingly, one of the objects of the present invention is to provide for adapting an EL panel having a semiconductor light sink layer behind the phosphor layer to generate light when the front ITO electrode is positive in potential relative to the back Al electrode.

Another object of the present invention is to provide for approximately doubling the light output of a pixel on an EL panel provided with a light sink layer of semiconductor material behind the phosphor layer thereof.

Another object of the present invention is to provide for eliminating any reflection of ambient light or rearwardly directed internally generated light at the interface of the phosphor and a light emission enhancing dielectric layer by matching the refractive indices of these layers.

Still another object of the present invention is to provide for the steepness of the luminance vs. voltage characteristic curve of an EL panel provided with a light sink layer formed of a semiconductor material to approach that of an ideal curve as desired for multiplexing operation of such a panel.

DETAILED DESCRIPTION OF THE INVENTION

Figure 1:
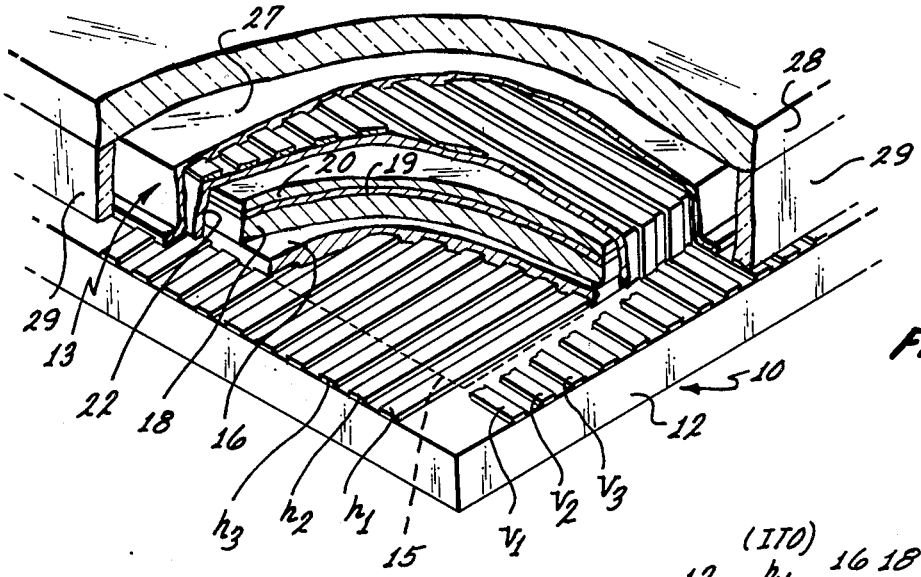
FIG. 1 is a perspective pictorial view showing a portion of a matrix-addressed thin-film EL panel having the light emission enhancing dielectric layer of the present invention deposited between the phosphor layer and the light sink layer thereof.

Referring to FIG. 1 of the drawings, an electroluminescent display panel 10 is shown to comprise a glass substrate 12 having deposited thereon a sandwich structure 13 comprised of a plurality of thin films or layers. The sandwich structure 13 is formed by first depositing a transparent layer of ITO (Indium Tin Oxide) to a thickness of about 1700 Angstrom units over the surface of the glass substrate 12 and then photoetching the ITO layer to form a plurality of parallel transparent electrodes $h_1$, $h_2$, --$h_n$. A first transparent dielectric layer such as yttria layer 16 is then deposited to a thickness of about 2000 Angstrom units over the active area 15 of the panel 10. Next a transparent phosphor layer 18, which may typically be zinc sulfide doped with an activator such as manganese, is deposited to a thickness of about 6000 Angstrom units over the yttria layer 16. In accordance with the present invention, a light emission enhancing layer 19 formed of a dielectric material, such as tantalum pentoxide ($Ta_2O_5$), for example, is deposited over the phosphor layer 18 to a thickness of at least 200 Angstrom units so as to provide a continuous film. A light sink layer 20 which is a light absorbing layer fabricated from a semiconductor compound of 20% PbTe and 80% CdTe:In is then deposited to a thickness of about 2500 Angstrom units over the light emission enhancing dielectric layer 19. The light sink layer is followed by a second yttria layer 22 which is deposited to a thickness of about 2000 Angstrom units. A plurality of parallel aluminum electrodes $v_1$, $v_2$, --$v_n$ is then deposited through a suitable mask to a thickness of about 1200 Angstrom units over the second yttria layer 22 so as to extend orthogonally, i.e., in a direction at right angles, to the transparent front electrodes $h_1$, $h_2$, --$h_n$. Finally, an insulating layer 27 such as alumina is deposited to a thickness of approximately 700 Angstrom units over the back surface of the sandwich structure so far formed to encapsulate the electrodes $v_1$, $v_2$, --$v_n$. A back glass protective cover 28 is then held on the glass substrate 12 so as to be slightly spaced from the thin-film structure 13 by a marginal seal 29 of resin.

Figure 2:
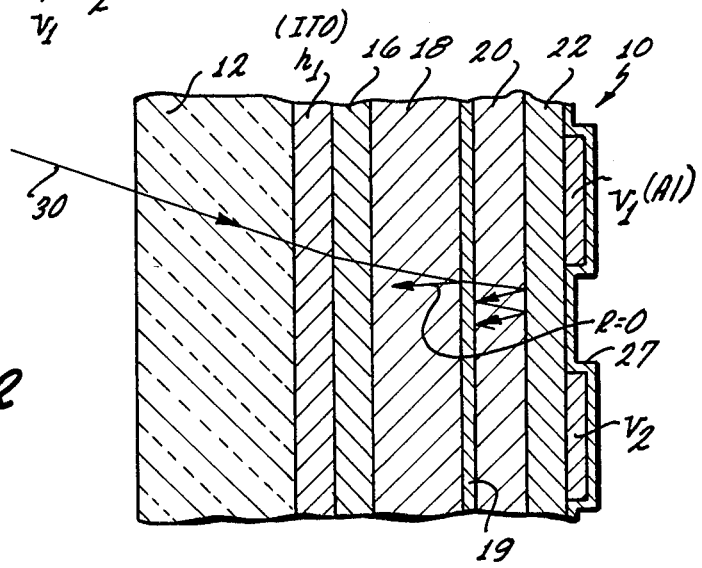
FIG. 2 is a schematic cross sectional view of the EL panel in FIG. 1 showing the path of an incident ambient light ray through the thin-film layers thereof.

Reference will next be made to FIG. 2 which is a schematic cross sectional view of the EL panel 10 showing the path of an incident ambient light ray 30 through the various thin-film layers thereof. Thus, the ambient light ray 30, upon entering the glass substrate 12 on the front of the EL panel 10 passes through the successive transparent layers into the light sink layer 20. Typically the ITO material forming electrodes $h_1$, $h_2$, --$h_n$ has an index of refraction of about 2.1, the first yttria layer 16 has an index of refraction of about 2.0, the phosphor layer 18 has an index of refraction of about 2.4, the light emission enhancing dielectric layer 19 has an index of refraction of about 2.4 to match that of the phosphor layer, the light sink layer 20 has an index of refraction of about 4.0, and the back yttria layer 22 has an index of refraction of about 2.0.

It is especially noted that inasmuch as the light emission enhancing dielectric layer 19 has substantially the same index of refraction as the phosphor layer 18, the reflection R of ambient light from the interface of these layers 18 and 19 is for all practical purposes equal to zero. Moreover, as a result of the light sink layer 20 having a very large absorption coefficient and a refractive index which is much higher than the two adjoining layers, namely, the light emission enhancing dielectric layer 19 and the second yttria layer 22, the ambient light that is incident on the light sink layer 20 is not reflected but is trapped by total internal reflection and absorbed within the layer by the light pipe effect.

Although not shown in FIG. 2, it should be appreciated that during the operation of the EL panel when the phosphor layer 18 is caused to internally generate light, approximately half of this generated light which is directed rearwardly is also passed without reflection into and through the light emission enhancing dielectric layer 19 into the light sink layer 20 wherein it is trapped by internal reflection and absorbed.

It should be understood that any reflections of the ambient light at the other interfaces of the EL panel shown in FIG. 2 are not indicated inasmuch as they are controlled to be at a minimum in other ways well known in the art.

Figure 3:
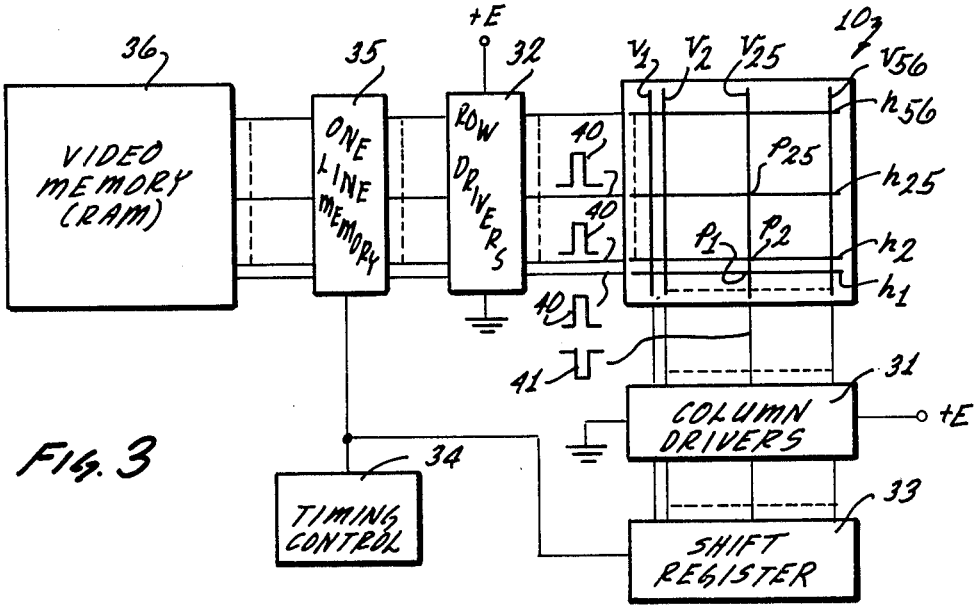
FIG. 3 is a block diagram schematically illustrating the multiplex drive operation of the EL panel in FIG. 1.

Reference will next be made to FIG. 3 which shows a block diagram of a typical matrix-addressed system for use with the EL panel 10 shown in FIG. 1. It is assumed that the EL panel 10 has 56 column electrodes $v_1$, $v_2$, --$v_{56}$; and 56 row electrodes $h_1$, $h_2$, --$h_{56}$.

Thus, as shown in FIG. 3, the EL panel 10 is provided with a series of column drivers 31 for individually applying driving voltages on the Al column electrodes $v_1$, $v_2$, --$v_{56}$ and with a series of row drivers 32 for individually applying driving voltages on the ITO row electrodes $h_1$, $h_2$, --$h_{56}$.

A shift register 33 is provided with a series of outputs each connected to control one of the series of column drivers 31. The shift register 33 advances a pulse therein, in response to each timing signal received from a timing control 34, to successively energize its outputs to gate a respective column driver 31 and thereby apply a drive voltage on each of the 56 column electrodes $v_1$, $v_2$, --$v_{56}$, in turn, during each frame time period that the EL panel is operating to display video information.

A one-line memory 35, which has a storage element therein associated with each of the 56 row electrodes $h_1$, $h_2$, --$h_{56}$, provides for controlling the applying of drive voltages by the respective row drivers 32. Thus, as a column of video data is successively fed, in parallel, out of a video RAM 36 into the one-line memory, in response to a timing signal received from the timing control 34, each of the storage elements of the one-line memory 35 that is storing a binary "1" digit serves to simultaneously gate a respective row driver 32 to apply a drive voltage on an associated row electrode $h_1$, $h_2$, --$h_{56}$.

As illustrated in FIG. 3, when one of the column drivers 31 is actuated to provide a drive voltage on Al electrode $v_{25}$, for example, and when the one-line memory 35 has a column of video data therein which simultaneously actuates selected ones of the row drivers 32 to simultaneously provide drive voltages on the ITO electrodes $h_1$, $h_2$, and $h_{25}$, for example, the pixels $p_1$, $p_2$, and $p_{25}$ along the selected Al electrode $v_{25}$ are caused to simultaneously luminesce. It should be appreciated, of course, that any number of the pixels along the selected Al electrode can be made to luminesce in this manner depending on the incoming video data in the one-line memory 35.

It is thus seen that when drive voltages are simultaneously applied on selected ones of the row electrodes $h_1$–$h_{56}$, selected ones of the pixels along the length of a selected one of the column electrodes $v_1$–$v_{56}$ will be multiplexed, i.e., simultaneously refreshed. By repeating the operation of successively reading a column of data in parallel from the video RAM 36 into the one-line memory 35 in a cylical manner, as the corresponding one of the column electrodes $v_1$–$v_{56}$ is selected to be driven, all the pixels on the EL panel are capable of being refreshed, in accordance with the video data, a column at a time, during each frame time period, and the operation repeats itself on successive frame time periods to maintain the picture on the El panel.

Figure 4:
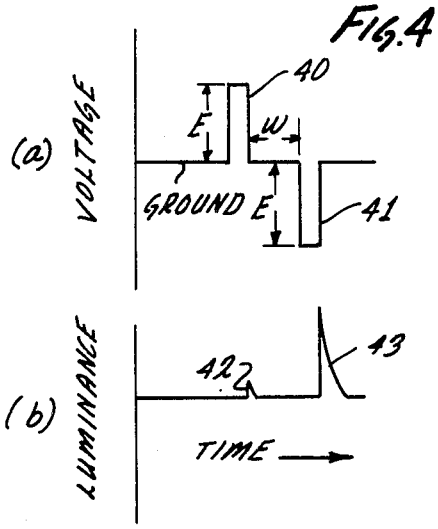
FIG. 4 shows waveforms of the drive voltage and the corresponding luminance output of a light sink EL panel without the light emission enhancing dielectric layer of the present invention.

In order to clearly explain the present invention, the refreshing of a pixel when the EL panel is provided with a light sink layer 20 but without the light emission enhancing layer 19 of the present invention will first be described in connection with FIGS. 4, 5 and 6.

FIG. 4*a* shows the drive voltage as applied across a pixel such as pixel $p_{25}$, for example, in FIG. 3, in order to refresh it. Inasmuch as electroluminescence is a function of a changing electric field it is necessary to employ a fluctuating energy, preferably in the form of square waves, across the electrodes. Thus, the drive voltage is initially in the form of a first square wave pulse 40 which is applied as a positive voltage E on the $h_{25}$ ITO row electrode and a ground on the $v_{25}$ Al column electrode so as to create an electric field polarized in one direction across the pixel $p_{25}$. Following this, both electrodes $v_{25}$ and $h_{25}$ are at ground for a short interval w. Then, the drive voltage is in the form of a second square wave pulse 41 which is applied as a positive voltage E on the $v_{25}$ Al column electrode and a ground on the $h_{25}$ ITO row electrode so as to create an electric field polarized in the opposite direction across the pixel $p_{25}$.

It should now be clearly understood that each time a pixel on the EL panel is refreshed it is necessary to reverse the electric field in this manner across a pixel since, if the electric field is always applied in the same polarity, the pixel becomes polarized and tends to emit less light each time it is refreshed.

Figure 5:
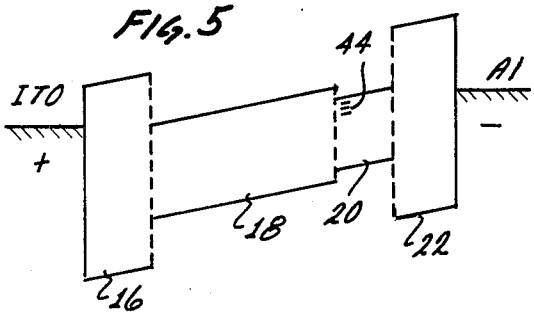
FIG. 5 illustrates the energy band diagram of an EL panel without the light emission enhancing layer of the present invention when the ITO electrode is positive in potential relative to the Al electrode.
Figure 6:
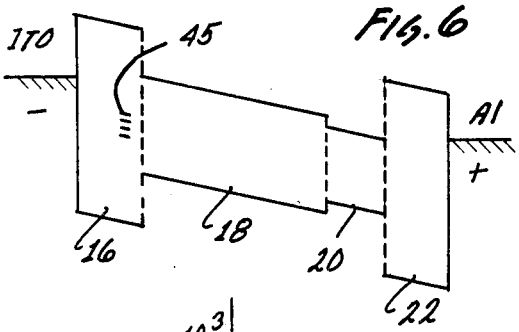
FIG. 6 illustrates the energy band diagram of an EL panel without the light emission enhancing dielectric layer of the present invention when the Al electrode is positive in potential relative to the ITO electrode.

Reference will next be made to FIG. 5 which illustrates the energy band diagram of a cell, such as pixel $p_{25}$, for example, in the EL panel, when the drive voltage applied thereacross is the square wave pulse 40 shown in FIG. 4*a*, i.e., the ITO electrode is positive in potential and the Al electrode is at ground or negative thereto. As a result of this square wave voltage pulse, an electric field is applied across the electrodes of the EL panel 10 as evidenced by the bending of the energy bands of the front dielectric layer 16, the phosphor layer 18, the light sink layer 20, and the back dielectric layer 22, so as to provide a gradient which slopes from the negative Al electrode down toward the positive ITO electrode.

The difference in the vertical lengths of the energy bands of the respective layers of the EL panel in FIG. 5 is a measure of the relative specific resistivities of the materials of these layers. Thus, the wider the energy gap for a material, as represented by the vertical length of its energy band, the greater the amount of energy (electron volts) needed to remove the electrons from the valence band to the conduction band. In this case, the materials of interest are those that interface with the opposite sides of the phosphor layer 18, namely, the yttria layer 16 on the front side thereof and the light sink layer 20 on the rear side thereof. Typically, electrons are trapped in shallow states or levels at a semiconductor-phosphor interface such as provided by the light sink layer 20, and electrons are trapped in deep states or levels at a dielectric-phosphor interface such as provided by the yttria layer 16.

Electrons always flow from the negative to the positive side of an electric field. Thus, when the square wave voltage pulse 40 is applied on the ITO electrode and the Al electrode is at ground or negative thereto, as the field builds up across the phosphor layer 18 due to the accumulation of electrons 44 on the light sink layer 20, when the voltage across the phosphor layer 18 is high enough some of the electrons 44 being held in the shallow levels in the light sink layer 20 are able to overcome the barrier, i.e., to be injected by a tunneling action through the light sink-phosphor interface into the phosphor layer 18. Upon entering the phosphor layer these electrons impact-excite the electrons in the Mn atoms. Then, upon the trailing edge of the square wave pulse 40 returning to ground, the excited electrons in the Mn atoms are returned to their ground states releasing whatever energy they have.

It should be appreciated that since the shallow level electrons 44 coming from the light sink-phosphor interface are injected at a relatively low voltage they have very little energy when they collide with the Mn atoms in the phosphor layer 18. Thus, these electrons generate, at the most, very little light when they return to their ground states as indicated by the luminance pulse 42 in FIG. 4*b* (non-radiative recombination).

As illustrated in FIG. 4*b*, upon the square wave pulse 40 returning to ground, an electric field no longer exists across the EL panel and consequently the energy band diagram flattens out horizontally, i.e., the gradient disappears (not shown). After a short time-off period, as indicated by w in FIG. 4*a*, the voltage is reversed across the pixel $p_{25}$ of the EL panel by applying the square wave pulse 41 in FIG. 4*a* on the Al electrode such that the Al electrode is now positive in potential and the ITO electrode is at ground or negative thereto. As a result, the electric field applied across the electrodes of the EL panel is now reversed, as evidenced by the bending of the energy bands of the layers of the EL panel so as to provide a gradient in the opposite direction, as indicated in FIG. 6.

Thus, when the voltage as represented by the square wave pulse 41 is applied across the pixel $p_{25}$ of the EL panel, the electrons 45 build up on the yttria layer 16 to create an electric field across the pixel $p_{25}$ in the opposite polarity. Then, when the voltage across the phosphor layer is high enough, some of the electrons 45 being held in the deep levels in the yttria layer 16 are able to overcome the barrier, i.e., to be injected by a tunneling action through the yttria-phosphor interface into the phosphor layer 18 wherein they collide with the Mn atoms causing electrons therein to move to a higher level. Then, upon the trailing edge of the square wave pulse 41 returning to ground, these high energy electrons return to their ground states. It should be appreciated that since the deep level electrons 45 coming from the yttria-phosphor interface are injected at a relatively high voltage they have sufficient energy to impact-excite the Mn atoms in the phosphor layer 18 on their return to their ground states and generate light as indicated by luminance pulse 43 in FIG. 4*b* (radiative recombination).

It should now be clearly understood that when the light sink layer 20 is positioned immediately behind the phosphor layer 18, it is only when the square wave pulse 41 is applied across the pixel $p_{25}$ of the EL panel, such that the Al electrode is positive in potential, that a significant amount of light is generated in the phosphor layer.

Figure 7:
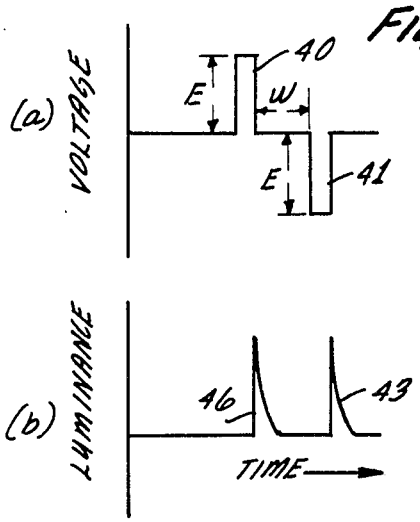
FIG. 7 shows the waveforms of the drive voltage and the corresponding luminance output of a light sink EL panel having the light emission enhancing layer of the present invention incorporated therein.
Figure 8:
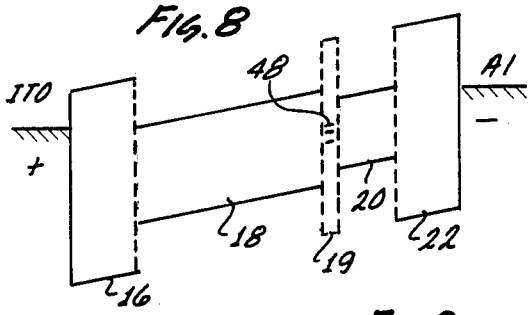
FIG. 8 illustrates the energy band diagram of an EL panel with the light emission enhancing dielectric layer of the present invention when the ITO electrode is positive in potential relative to the Al electrode.
Figure 9:
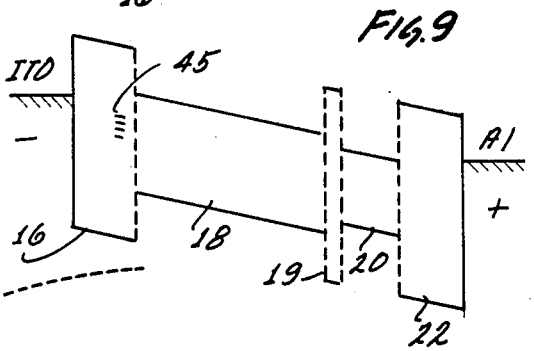
FIG. 9 illustrates the energy band diagram of an EL panel with the light emission enhancing dielectric layer of the present invention when the Al electrode is positive in potential relative to the ITO electrode.

Having described the operation of the EL panel with a semiconductor light sink layer 20 but without the light emission enhancing dielectric layer 19, next to be described, in connection with FIGS. 7, 8 and 9, is an EL panel provided with a semiconductor light sink layer 20 and also the light emission enhancing dielectric layer 19 in accordance with the present invention.

Referring to FIGS. 8 and 9, the energy band diagrams of the EL panel 10 are shown under applied fields when the EL panel is formed with the light emission enhancing dielectric layer 19 incorporated between the phosphor layer 18 and the light sink layer 20. The light emission enhancing dielectric layer 19, as previously mentioned, may be a material such as $Ta_2O_5$ having deep interface levels with phosphor. Thus, FIG. 8 shows the electric field applied across the pixel $p_{25}$ of the EL panel when, as a result of the square wave pulse 40, FIG. 7*a*, the ITO electrode is positive in potential and the Al electrode is negative in potential. In this case, inasmuch as the light emission enhancing dielectric layer 19 interfaces with the phosphor layer 18, the deep level electrons 48 therein are eventually able, when the voltage thereacross builds up sufficiently, to overcome the barrier, i.e., to be injected by a tunneling action through the light emission enhancing dielectric-phosphor interface into the phosphor layer wherein they impact-excite the Mn atoms, causing emission of light as indicated by the luminance pulse 46 in FIG. 7*b*.

Moreover, when the square wave pulse 41 in FIG. 7*a* is applied across the EL panel such that the Al electrode is positive in potential and the ITO electrode is negative in potential, the electric field created across the EL panel causes the energy band diagram of the EL panel to appear as illustrated in FIG. 9 with a gradient extending down from the negative ITO electrode to the positive Al electrode. As a result, similar to FIG. 6, some of the deep level electrons 45 on the front yttria layer 16 which interfaces with the phosphor layer are injected with high energy by a tunneling action into the phosphor layer 18 where they impact-excite the Mn atoms, causing emission of light as indicated by the luminance pulse 43 in FIG. 7*b*.

It should be clearly understood that when the light emission enhancing dielectric layer 19 is provided between the phosphor layer 18 and the light sink layer 20, the EL panel is now caused to emit light during the first half cycle of the refreshing operation in response to the voltage square wave pulse 40 as well as during the last half cycle of the refreshing operation in response to the voltage square wave pulse 41. Moreover, inasmuch as there is no reflection of ambient incident light or rearwardly directed internally generated light at the interface of the phosphor layer and the light emission enhancing dielectric layer, the background of the EL panel continues to appear black as when the light sink layer 20 is positioned immediately behind the phosphor layer 18.

It should be understood that although many dielectric materials can be used behind the phosphor layer to supply high energy electrons, the use of a dielectric material such as $Ta_2O_5$, having an index of refraction which is substantially the same as the phosphor, i.e., an optically matched material, assures that there is no ambient incident light or rearwardly directed internally generated light reflected at this interface. Thus, if yttria were to be used instead of $Ta_2O_5$, because of lower index of refraction of the yttria as compared to phosphor, there would be a reflection of such light at this interface which would cause the background of the EL panel to appear gray, and adversely affect its contrast ratio.

The dielectric materials, in addition to $Ta_2O_5$, that have an index of refraction which is substantially the same as the phosphor layer and can, therefore, be used for the light emission enhancing dielectric layer 19 include $BaTiO_3$, $CeO_2$, $Cr_2O_3$, $As_2S_3$, $PbCl_2$, $TiO_2$, $Ti_2O_3$ and TiO.

Preferably these materials are sputtered onto the back of the phosphor layer but they could also be evaporated. Although the thickness of these dielectric materials is not critical, a thickness of at least 200 Angstrom units assures that a continuous layer will be present. Moreover, the thinner the layer the less the drop in voltage provided thereacross.

It should now be noted that the light emission enhancing dielectric layer 19 does not adversely affect the operation of the light sink layer 20 in any way because it provides for both the incident ambient light and the rearwardly directed internally generated light to pass, without reflection, from the phosphor layer into the light sink layer wherein it is trapped and absorbed. Thus, the new light emission enhancing dielectric layer 19 may, optically, be considered merely as an extension of the phosphor layer 18. Accordingly, the end result of introducing the light emission enhancing dielectric layer 19 between the phosphor layer and the light sink layer is to greatly increase the efficiency of the EL panel.

It should now be clearly understood that the primary purpose of the new light emission enhancing dielectric layer is to supply the high energy electrons as needed during a refresh operation for impact excitation of luminescent centers of the phosphor to create light. The back yttria layer 22, or a similar layer, is preferably still needed in the EL panel to provide for insulating the back Al electrodes from the light sink layer 20.

Thus, during a refreshing operation, upon comparing the light output as indicated by the luminance pulse output in FIG. 4*b* with the luminance pulse output in FIG. 7*b*, the luminance or brightness of the light sink EL panel with the light emission enhancing dielectric layer 19 of the present invention, as illustrated in FIG. 7*b*, is found to be almost 100% greater than that of a light sink EL panel without such a layer.

Figure 10:
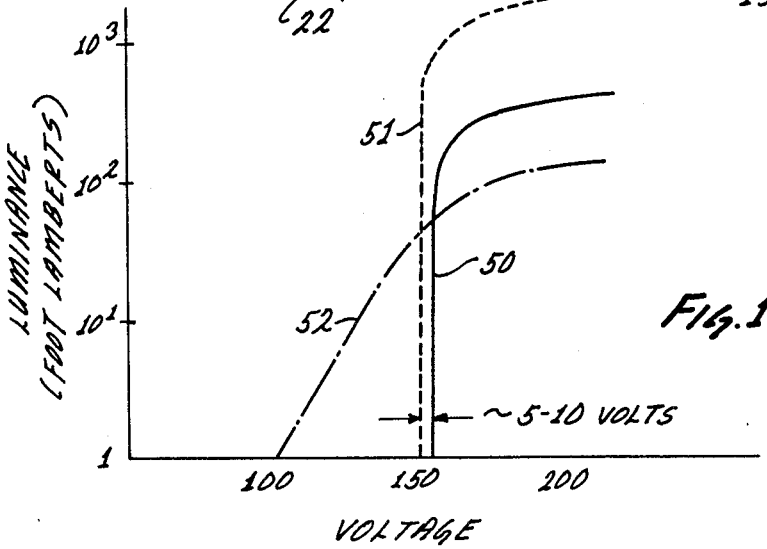
FIG. 10 shows the luminance vs. voltage characteristic curves of a light sink EL panel with and without the light emission enhancing dielectric layer of the present invention.

Referring to FIG. 10, a typical luminance vs. voltage characteristic curve of a light sink EL panel with the light emission enhancing dielectric layer 19 of the present invention is shown by the solid line curve 50. It should be noted that the curve 50 has a very steep slope which is substantially the same as the ideal slope of the characteristic curve 51 of an EL panel without a light sink layer, as shown by the dashed line curve 51. It is noted that the threshold voltage of the curve 50 is increased approximately 5 to 10 volts relative to the curve 51 because of the voltage drop across the light emission enhancing dielectric layer 19. However, this can be corrected, for example, by decreasing the thickness of the back dielectric layer 22.

Moreover, upon comparing the curve 50 with a luminance vs. voltage characteristic curve of an EL panel having a high resistivity light sink layer but no light emission enhancing dielectric layer, as indicated by the dot-dashed line curve 52, it is noted that the slope of the curve 50 is much steeper thereby showing that the light emission enhancing dielectric layer 19 greatly improves the multiplexing operation of the panel.

While in order to comply with the statute the invention has been shown and described in language more or less specific as to structural features, it is to be understood that the invention is not limited thereto, but that the means and construction herein disclosed comprise a preferred form of putting the invention into effect and the invention therefore is claimed in any of its forms or modifications within the legitimate and valid scope of the appended claims.

What is claimed is:

1. An improved structure for a thin-film electroluminescent device comprising:

a substrate;

a plurality of transparent front electrodes deposited on said substrate and extending in one direction;

a front dielectric layer deposited over said transparent front electrodes;

a phosphor layer having luminescent centers deposited over said front dielectric layer, said phosphor layer having a given refractive index;

a light emission enhancing dielectric layer having a refractive index substantially equal to that of the phosphor layer deposited over said phosphor layer;

a light sink layer deposited over said light emission enhancing dielectric layer;

a back dielectric layer deposited over said light sink layer; and a plurality of back electrodes deposited over said back dielectric layer and extending orthogonally to the direction of said transparent front electrodes;

said front and back electrodes adapted to having a driving potential applied first in one polarity and then the opposite polarity across intersecting portions thereof during a refresh cycle;

whereby during a refresh cycle when the back electrode at an intersecting portion is positive in potential the front dielectric layer coacts with the phosphor layer to generate light and when the front electrode at the intersecting portion is positive in potential the light emission enhancing dielectric layer coacts with the phosphor layer to generate light.

2. An improved structure for a thin-film electroluminescent device as defined in claim 1 wherein said light emission enhancing dielectric layer is just sufficiently thick enough to make it continuous.

3. An improved structure for a thin-film electroluminescent device as defined in claim 1 wherein said light sink layer is a high specific resistivity semiconductor material which includes CdTe doped with indium.

4. An improved structure for a thin-film electroluminescent device as defined in claim 1 wherein said light emission enhancing dielectric layer is comprised of material from the group consisting of $Ta_2O_5$, $BaTiO_3$, $CeO_2$, $Cr_2O_3$, $As_2S_3$, $PbCl_2$, $TiO_2$, $Ti_2O_3$ and TiO.

5. An improved structure for a thin-film electroluminescent device as defined in claim 1 wherein said light emission enhancing dielectric layer is at least 200 Angstrom units thick.

6. An electroluminescent device which is energizable to a high luminance upon each reversal of the potential applied thereacross said device comprising:

a substrate means;

a front electrode carried on said substrate means;

a front dielectric layer disposed over said front electrode;

a phosphor layer having luminescent centers disposed over said front dielectric layer;

a light emission enhancing dielectric disposed over said phosphor layer, said enhancing layer having a refractive index substantially equal to that of said phosphor layer;

a light sink layer formed of a semiconductor compound disposed over said light emission enhancing dielectric layer;

said light emission enhancing dielectric layer receiving ambient incident light and rearwardly directed internally generated light from said phosphor layer without reflection and passing said light through to the light sink layer wherein it is trapped by internal reflection and absorbed;

an insulation layer disposed over said light sink layer; and a back electrode disposed over said insulation layer;

said front and back electrodes adapted to have a potential applied first in one polarity and then the reverse polarity thereacross for energizing said device;

whereby when the potential across said front and back electrodes is such that said front electrode is positive in potential high energy electrons are injected from the light emission enhancing dielectric-phosphor interface to impact-excite the luminescent centers in said phosphor layer to generate light; and whereby when the potential across said front and back electrodes is such that said back electrode is positive in potential high energy electrons are injected from the front dielectric-phosphor interface to impact-excite the luminescent centers in said phosphor layer to generate light.

7. An electroluminescent panel comprising:

a front electrode;

a back electrode; and a multi-layer sandwiched between said electrodes;

said front and back electrodes being adapted to receive a voltage therebetween to provide an electric field across said multilayer;

said multilayer comprising:

a front dielectric layer disposed over said front electrode;

a phosphor layer formed of ZnS doped with Mn disposed over said front dielectric layer;

a light emission enhancing dielectric layer disposed over said phosphor layer and having substantially the same index of refraction as said phosphor layer;

a light sink layer disposed over said light emission enhancing dielectric layer; and a back dielectric layer disposed between said light sink layer and said back electrode;

said light sink layer having a high absorption coefficient and a substantially higher index of refraction than the light emission enhancing dielectric layer on the front side thereof and the back dielectric layer on the back side thereof;

said light emission enhancing dielectric layer receiving ambient incident light and rearwardly directed internally generated light from said phosphor layer without reflection and passing said light through to the light sink layer wherein it is trapped by internal reflection and absorbed; and whereby when said panel is provided with a voltage across said front and back electrodes such that said front electrode is positive in potential with respect to said back electrode high energy electrons are injected from the light emission enhancing dielectric-phosphor interface to impact-excite the Mn atoms in the phosphor layer to generate light; and whereby when said panel is provided with a voltage between said front and back electrodes such that said back electrode is positive in potential with respect to said front electrode high energy electrons are injected from the front dielectric-phosphor interface to impact-excite the Mn atoms in the phosphor layer to generate light.

8. A thin-film electroluminescent device comprising:

a phosphor layer having luminescent centers, said phosphor layer having a given refractive index;

a front transparent dielectric layer deposited on the front of said phosphor layer;

a plurality of transparent electrodes in front of said first dielectric layer;

a light emission enhancing dielectric layer having the same refractive index as said phosphor layer deposited on the back of said phosphor layer;

a light sink layer of a semiconductor compound deposited on the back of said light emission enhancing dielectric layer; and a back dielectric layer deposited on the back of said light sink layer;

said light sink layer having a high absorption coefficient and a substantially higher index of refraction than the light emission enhancing dielectric layer on the front side thereof and the back dielectric layer on the back side thereof; and a plurality of counter electrodes on the back of said back dielectric layer;

said transparent and counter electrodes adapted to have a driving potential in one polarity and then the opposite polarity applied across intersecting pairs thereof;

whereby when said driving potential is applied such that said transparent electrode is positive in potential high energy electrons are injected from the light emission enhancing dielectric-phosphor interface into said phosphor layer to cause said phosphor layer to emit light, and when said driving potential is applied such that said counter electrode is positive in potential high energy electrons are injected from the front dielectric-phosphor interface into said phosphor layer to cause said phosphor layer to emit light; and whereby ambient light and rearwardly directed internally generated light incident on the interface of the phosphor layer and the light emission enhancing dielectric layer is not reflected but passed through the light emission enhancing dielectric layer into the light sink layer wherein it is trapped by internal reflection and absorbed.

* * * * *